US011647782B2

(12) United States Patent
Dotton

(10) Patent No.: US 11,647,782 B2
(45) Date of Patent: May 16, 2023

(54) CONICAL ROLLING PAPER ASSEMBLY

(71) Applicant: Jomont Dotton, N Las Vegas, NV (US)

(72) Inventor: Jomont Dotton, N Las Vegas, NV (US)

( * ) Notice: Subject to any disclaimer, the term of this patent is extended or adjusted under 35 U.S.C. 154(b) by 217 days.

(21) Appl. No.: 17/225,175

(22) Filed: Apr. 8, 2021

(65) Prior Publication Data

US 2022/0322733 A1 Oct. 13, 2022

(51) Int. Cl.
*A24D 1/02* (2006.01)
*A24D 1/04* (2006.01)

(52) U.S. Cl.
CPC ..... *A24D 1/022* (2013.01); *A24D 1/045* (2013.01)

(58) Field of Classification Search
CPC ..... A24D 1/022; A24D 1/045
See application file for complete search history.

(56) References Cited

U.S. PATENT DOCUMENTS 4,771,795 A 9/1988 White
4,917,128 A 4/1990 Clearman
5,033,483 A 7/1991 Clearman
9,282,765 B1 3/2016 Sinclair, Jr.
2016/0309776 A1 10/2016 Pammer

FOREIGN PATENT DOCUMENTS

CA 2515557 C * 4/2017 ..... A24D 3/04

* cited by examiner

*Primary Examiner* — Michael J Felton
*Assistant Examiner* — Ronnie Kirby Jordan

(57) ABSTRACT

A conical rolling paper assembly for rolling a cigarette includes a rolling paper for rolling into a cigarette for smoking. The rolling paper is pre-formed into a conical shape having a narrow end that has a diameter is less than a wide end. Moreover, the rolling paper is rollable into a cone of a pre-determined diameter for having smoking material placed therein. The wide end of is inhaled through by a user and the narrow end is ignited for smoking. A filter is insertable into the wide end when the smoking material is positioned in the cone defined by the rolling paper. The filter has an air aperture extending therethrough to be inhaled through by the user for smoking the smoking material in the rolling paper.

6 Claims, 2 Drawing Sheets

CONICAL ROLLING PAPER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to rolling paper devices and more particularly pertains to a new rolling paper device for rolling a cigarette.

(2) Description of Related Art Including Information Disclosed Under 37 CFR 1.97 and 1.98

The prior art relates to rolling paper devices. The prior art discloses a cylinder defining a cigarette and a filter that includes a heat activated element for releasing a flavor into smoke produced by combustion. The prior art discloses an electronic cigarette that includes a high heat element and a low heat element. The prior art also discloses a cigarette that includes a combustible material which surrounds a portion of tobacco for providing a smoke with the taste of tobacco without smoking the tobacco. Additionally, the prior art discloses a plurality of frusto-conical tubes for containing a smoking material.

BRIEF SUMMARY OF THE INVENTION

An embodiment of the disclosure meets the needs presented above by generally comprising a rolling paper for rolling into a cigarette for smoking. The rolling paper is pre-formed into a conical shape having a narrow end that has a diameter is less than a wide end. Moreover, the rolling paper is rollable into a cone of a pre-determined diameter for having smoking material placed therein. The wide end of is inhaled through by a user and the narrow end is ignited for smoking. A filter is insertable into the wide end when the smoking material is positioned in the cone defined by the rolling paper. The filter has an air aperture extending therethrough to be inhaled through by the user for smoking the smoking material in the rolling paper.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
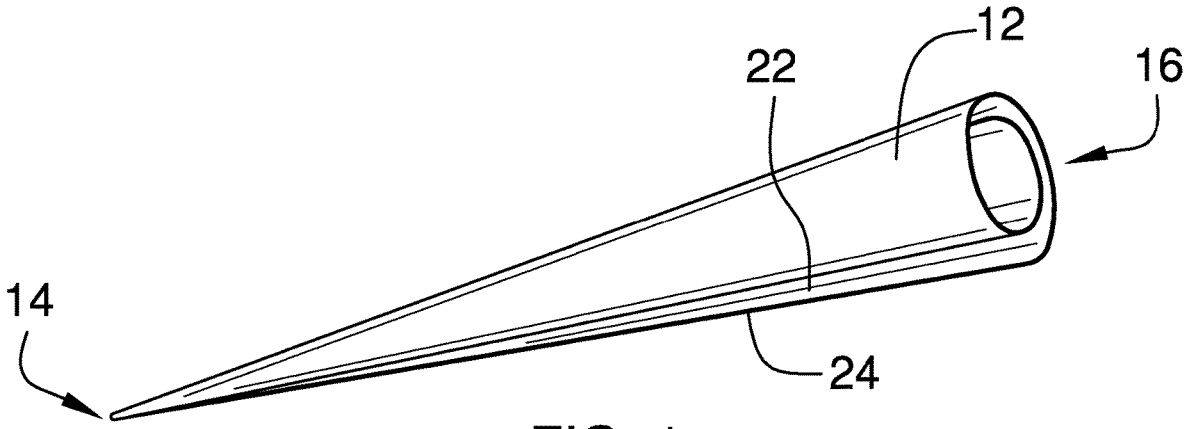
FIG. 1 is a perspective view of a conical rolling paper assembly according to an embodiment of the disclosure showing a rolling paper in pre-formed conical shape.
Figure 2:
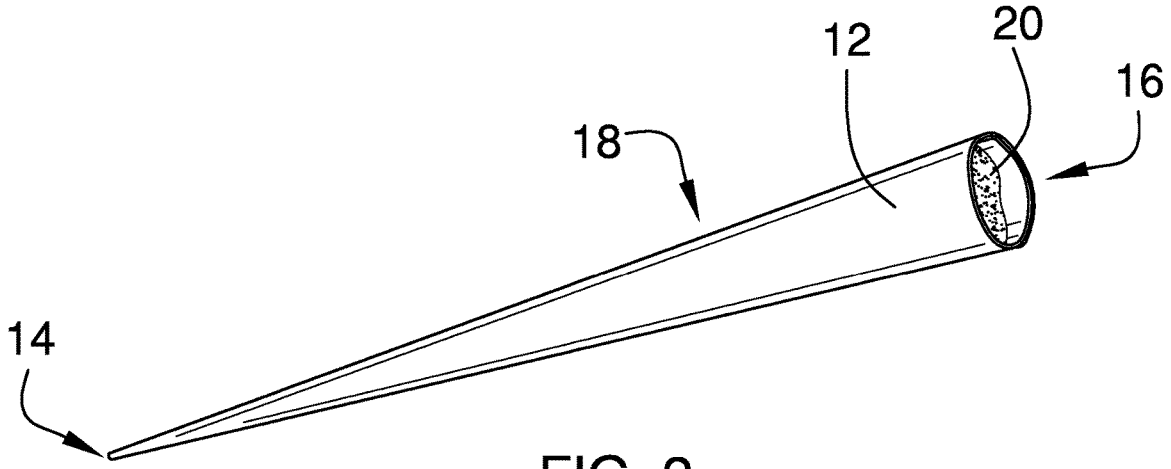
FIG. 2 is a perspective view of an embodiment of the disclosure showing a rolling paper rolled into a cone containing smoking material.
Figure 3:
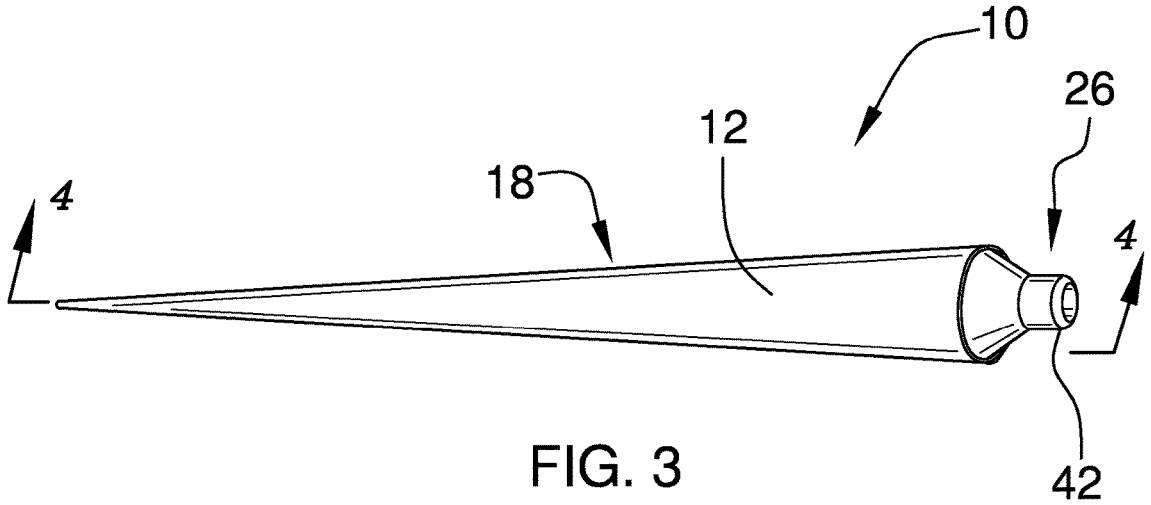
FIG. 3 is a perspective view of an embodiment of the disclosure showing a filter having been inserted into a rolling paper.
Figure 4:
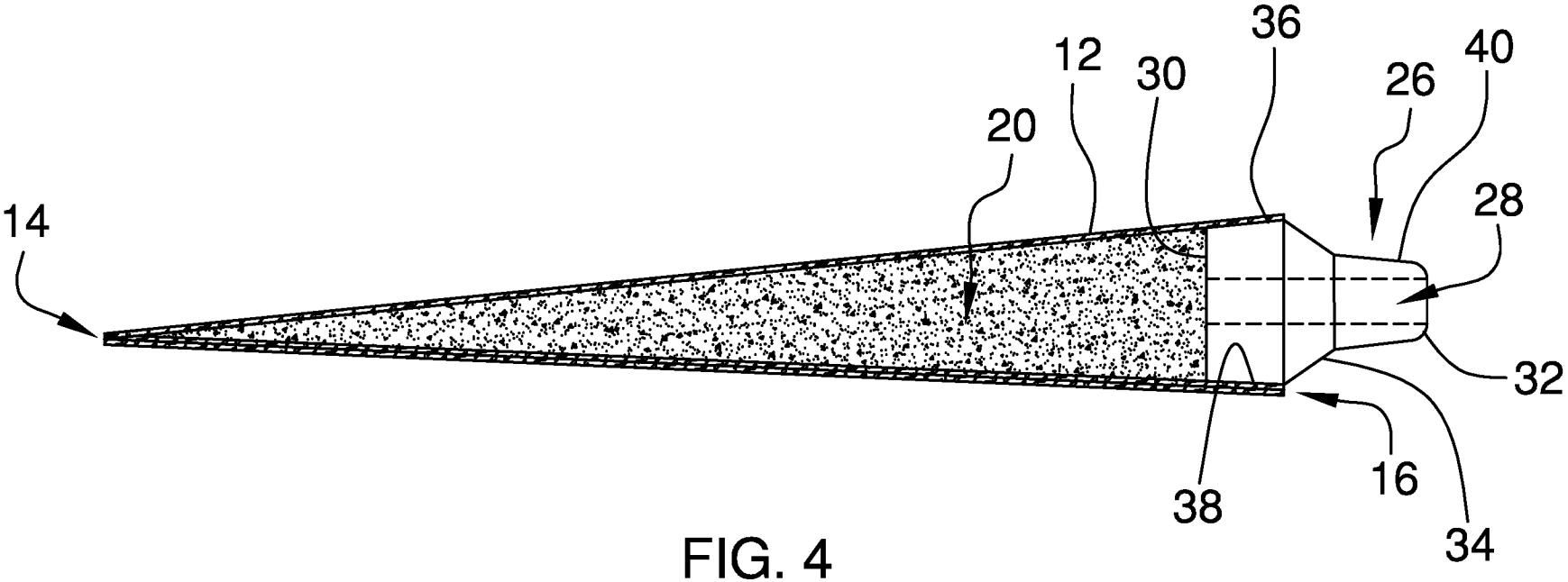
FIG. 4 is a cross sectional view taken along line 4-4 of FIG. 3 of an embodiment of the disclosure.

With reference now to the drawings, and in particular to FIGS. 1 through 4 thereof, a new rolling paper device embodying the principles and concepts of an embodiment of the disclosure and generally designated by the reference numeral 10 will be described.

As best illustrated in FIGS. 1 through 4, the conical rolling paper assembly 10 generally comprises a rolling paper 12 that is comprised of a combustible material for rolling into a cigarette for smoking. The rolling paper 12 is pre-formed into a conical shape that has a narrow end 14 which has a diameter that is less than a wide end 16. Moreover, the rolling paper 12 is rollable into a cone 18 of a pre-determined diameter thereby facilitating a pre-determined amount of smoking material 20, such as tobacco, cannabis or other plant, to be placed therein. The wide end 16 of is inhaled through by a user and the narrow end 14 is ignited for smoking. The rolling paper 12 may be comprised of hemp paper or other organic material for enhancing smoothness of the cigarette with respect to inhaling smoke. Additionally, the rolling paper 12 may have a water activated adhesive strip 22 that extends along a perimeter edge 24 of the rolling paper 12 for retaining the rolling paper 12 in the cone 18.

A filter 26 is provided and the filter 26 insertable into the wide end 16 when the smoking material 20 is positioned in the cone 18 defined by the rolling paper 12. The filter 26 has an air aperture 28 extending therethrough to be inhaled through by the user for smoking the smoking material 20 in the rolling paper 12. The filter 26 has a first end 30, a second end 32 and an outer wall 34 extending therebetween. The outer wall 34 has a first portion 36 extending from the first end 30 toward the second end 32. Additionally, the first portion 36 flares outwardly such that the first portion 36 conforms to an inner surface 38 of the cone 18 formed by the rolling paper 12 when the filter 26 is inserted into the wide end 16. In this way the filter 26 enhances combustion of the smoking material 20 by inhibiting air from passing between the filter 26 and the rolling paper 12.

The outer wall 34 has a second portion 40 extending between the first portion 36 and the second end 32. The second portion 40 tapers to a diameter that is less than the diameter of the first portion 36 thereby defining a mouthpiece 42 on the filter 26. Thus, the mouthpiece 42 can be sucked on the by user for smoking. The air aperture 28 extends through the first end 30 and the second end 32, and the filter 26 may be comprised of a heat resistant material.

In use, the rolling paper 12 is rolled into the cone 18 of the desired size around a pre-determined amount of the smoking material 20. The first end 30 of the filter 26 is inserted into the wide end 16 of the cone 18 such that the rolling paper 12 is wrapped around the first portion 36 of the filter 26. The narrow end 14 of the cone 18 is ignited and the filter 26 is inhaled through for smoking the smoking material 20. In this way the traditional method of inhaling through a narrow end of a cigarette and igniting a wide end of the cigarette is reversed. Reversing the direction of air flow through the cone 18 facilitates a greater amount of resin, produced by combustion, to be mixed with the remaining smoking material 20 thereby enhancing the smoking experience.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A conical rolling paper assembly for rolling a cone shaped cigarette for smoking, said assembly comprising:

a rolling paper being comprised of a combustible material wherein said rolling paper is configured to be rolled into a cigarette for smoking, said rolling paper being pre-formed into a conical shape having a narrow end that has a diameter being less than a wide end, said rolling paper being rollable into a cone of a pre-determined diameter wherein said rolling paper is configured to have smoking material placed therein, wherein said wide end of is configured to be inhaled through by a user, said narrow end being configured to be ignited for smoking; and a filter being insertable into said wide end when the smoking material is positioned in said cone defined by said rolling paper, said filter having an air aperture extending therethrough wherein said filter is configured to be inhaled through by the user for smoking the smoking material in said rolling paper.

2. The assembly according to claim 1, wherein said filter has a first end, a second end and an outer wall extending therebetween, said air aperture extending through said first end and said second end.

3. The assembly according to claim 2, wherein said outer wall has a first portion extending from said first end toward said second end, said outer wall having a second portion extending between said first portion and said second end.

4. The assembly according to claim 3, wherein said first portion flares outwardly such that said first portion conforms to an inner surface of said cone formed by said rolling paper when said filter is inserted into said wide end wherein said filter is configured to inhibit air from passing between said filter and said rolling paper.

5. The assembly according to claim 3, wherein said second portion tapers to a diameter being less than the diameter of said first portion thereby defining a mouthpiece on said filter wherein said mouthpiece is configured to be sucked on the by user for smoking.

6. A conical rolling paper assembly for rolling a cone shaped cigarette for smoking, said assembly comprising:

a rolling paper being comprised of a combustible material wherein said rolling paper is configured to be rolled into a cigarette for smoking, said rolling paper being pre-formed into a conical shape having a narrow end that has a diameter being less than a wide end, said rolling paper being rollable into a cone of a pre-determined diameter wherein said rolling paper is configured to have smoking material placed therein, wherein said wide end of is configured to be inhaled through by a user, said narrow end being configured to be ignited for smoking; and a filter being insertable into said wide end when the smoking material is positioned in said cone defined by said rolling paper, said filter having an air aperture extending therethrough wherein said filter is configured to be inhaled through by the user for smoking the smoking material in said rolling paper, said filter having a first end, a second end and an outer wall extending therebetween, said outer wall having a first portion extending from said first end toward said second end, said first portion flaring outwardly such that said first portion conforms to an inner surface of said cone formed by said rolling paper when said filter is inserted into said wide end wherein said filter is configured to inhibit air from passing between said filter and said rolling paper, said outer wall having a second portion extending between said first portion and said second end, said second portion tapering to a diameter being less than the diameter of said first portion thereby defining a mouthpiece on said filter wherein said mouthpiece is configured to be sucked on the by user for smoking, said air aperture extending through said first end and said second end.

* * * * *